US007654515B2

(12) United States Patent
Koga

(10) Patent No.: US 7,654,515 B2
(45) Date of Patent: Feb. 2, 2010

(54) IMAGE FORMING DEVICE WITH TWO ATTACHED CASSETTES AND ONE TRANSPORTATION DEVICE

(75) Inventor: Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 399 days.

(21) Appl. No.: 11/564,317

(22) Filed: Nov. 29, 2006

(65) Prior Publication Data

US 2007/0120314 A1 May 31, 2007

(30) Foreign Application Priority Data

Nov. 29, 2005 (JP) ..... 2005-343194

(51) Int. Cl.
*B65H 3/44* (2006.01)

(52) U.S. Cl. ..... 271/9.08; 271/9.11; 271/117; 271/164

(58) Field of Classification Search ..... 271/9.08, 271/9.07, 9.17, 9.11, 117, 162, 164
See application file for complete search history.

(56) References Cited

U.S. PATENT DOCUMENTS 3,348,464 A * 10/1967 Sturdevant ..... 355/78
4,017,181 A * 4/1977 Komaba et al. ..... 355/72
4,131,274 A * 12/1978 Sue ..... 271/9.11
4,303,235 A * 12/1981 Calabrese ..... 271/162
5,116,034 A * 5/1992 Trask et al. ..... 271/2
5,346,197 A * 9/1994 Takano et al. ..... 271/9.05
5,895,041 A * 4/1999 Nishimura ..... 271/171
6,000,870 A * 12/1999 Koga ..... 400/605
6,179,499 B1 * 1/2001 Beretta et al. ..... 400/605
6,406,201 B1 * 6/2002 Beretta et al. ..... 400/605

(Continued)

FOREIGN PATENT DOCUMENTS

JP 60232338 A * 11/1985

(Continued)

OTHER PUBLICATIONS

Japan Patent Office, Notification of Reasons for Rejection in Japanese Patent Application No. 2005-343194 (counterpart to the above-captioned U.S. Patent Application) mailed Jan. 21, 2009.

*Primary Examiner*—Patrick H Mackey
*Assistant Examiner*—Gerald W McClain
(74) *Attorney, Agent, or Firm*—Baker Botts, LLP.

(57) ABSTRACT

An image forming device is provided with a device main body, a first cassette, a second cassette that is capable of moving between a first position and a second position with respect to the device main body, a transportation device, and a printing device. The transportation device is capable of transporting a print medium housed in the first cassette in a case where the first cassette is positioned at a predetermined position wit respect to the device main body and the second cassette is positioned at the first position. The transportation device is capable of transporting a print medium housed in the second cassette in a case where the second cassette is positioned at the second position. The printing device prints an image on the print medium transported by the transportation device. A part of the second cassette positioned at the first position and/or the second position is positioned outside the device main body.

16 Claims, 13 Drawing Sheets

U.S. PATENT DOCUMENTS

| | | | | |
|---|---|---|---|---|
| 6,659,443 | B1 * | 12/2003 | Eskey | 271/9.08 |
| 6,688,590 | B2 * | 2/2004 | Billings et al. | 271/9.05 |
| 6,776,405 | B2 * | 8/2004 | Eskey | 271/9.08 |
| 6,851,670 | B2 * | 2/2005 | Todd | 271/145 |
| 7,413,183 | B2 * | 8/2008 | Asada et al. | 271/117 |
| 2006/0083566 | A1 * | 4/2006 | Hwang | 399/391 |

FOREIGN PATENT DOCUMENTS

| | | | |
|---|---|---|---|
| JP | 61188335 | A * | 8/1986 |
| JP | H03-166134 | A | 7/1991 |
| JP | 5-1738 | U | 1/1993 |
| JP | H51738 | | 1/1993 |
| JP | 6-49439 | U | 7/1994 |
| JP | H649439 | | 7/1994 |
| JP | 2000247456 | | 9/2000 |

* cited by examiner

IMAGE FORMING DEVICE WITH TWO ATTACHED CASSETTES AND ONE TRANSPORTATION DEVICE

CROSS-REFERENCE TO RELATED APPLICATION

This application claims priority to Japanese Patent Application No. 2005-343194, filed on Nov. 29, 2005, the contents of which are hereby incorporated by reference into the present application.

BACKGROUND OF THE INVENTION

1. Field of the Invention

The present invention relates to an image forming device having at least two cassettes for housing a print medium.

2. Description of the Related Art

Image forming devices such as printers, copiers, fax machines, multi-function devices, etc. are widely known. A normal image forming device has a device main body, a cassette, a transportation device, and a printing device. The cassette is capable of housing a print medium, and is housed within the device main body. The transportation device transports the print medium housed in the cassette toward the printing device. The printing device prints the print medium that has been transported from the cassette. An image is thus formed on the print medium.

Image forming devices having two or more cassettes are known. Each cassette can house a print medium of a different size or different material.

Japanese Utility Model Application Publication No. 6-49439 teaches a pair of feeding cassettes that are attached to a cassette base. The feeding cassettes are capable of housing different size print mediums. One feeding cassette can slide with respect to the other feeding cassette. In the case where the one feeding cassette is located at a first position with respect to the other feeding cassette, the print medium housed in the one feeding cassette is transported by a roller. In the case where the one feeding cassette is located at a second position with respect to the other feeding cassette, the print medium housed in the other feeding cassette is transported by the roller.

In that document (JP 6-49439), a device main body of an image forming device is not disclosed. Consequently the positional relationship between the device main body and the pair of feeding cassettes cannot be understood.

BRIEF SUMMARY OF THE INVENTION

This specification teaches an image forming device that has utility not taught in the aforementioned prior art.

The image forming device comprises a device main body, a first cassette, a second cassette, a transportation device, and a printing device. The first cassette and the second cassette are housed in the device main body. Here 'housed' refers to at least a part of the first cassette (or the second cassette) being housed in the device main body.

The second cassette is capable of moving between a first position and a second position with respect to the device main body. In the case where the first cassette is positioned at a predetermined position with respect to the device main body and the second cassette is positioned at the first position, the transportation device is capable of transporting the print medium housed in the first cassette. In the case where the second cassette is positioned at the second position, the transportation device is capable of transporting the print medium housed in the second cassette. The printing device prints an image on the print medium transported by the transportation device.

By changing the position of the second cassette, a user can select whether the print medium housed in the first cassette or the print medium housed in the second cassette will be utilized.

In this image forming device, a part of the second cassette located at the first position and/or the second position is positioned outside the device main body. It is consequently easy for the user to ascertain the position of the second cassette.

BRIEF DESCRIPTION OF THE DRAWINGS

FIG. 3 shows a state where a second feeding cassette is located at a position furthermost to the front.

FIG. 4 shows a state where the second feeding cassette is located at a position furthermost to the rear.

FIG. 5 shows a state where the second feeding cassette is located at a central position.

FIG. 6 shows a state where the second feeding cassette is located at the position furthermost to the front.

FIG. 7 shows a state where the second feeding cassette is located at the position furthermost to the rear.

FIG. 8 shows a state where the second feeding cassette is located at the central position.

FIG. 9 shows a state where the second feeding cassette is located at the position furthermost to the front.

FIG. 11 shows a state where the second feeding cassette is located at the position furthermost to the front.

FIG. 12 shows a state where the second feeding cassette is located at the position furthermost to the rear.

FIG. 13 shows a state where the second feeding cassette is located at the central position.

DETAILED DESCRIPTION OF THE INVENTION

FIRST EMBODIMENT

A first embodiment of the present invention will be described in detail below with reference to the figures. FIGS. 1 to 10 show an image forming device of the first embodiment.

An image forming device 1 of the present embodiment is a multi-function device (MFD) having a printer function, a copy function, a scanner function, and a fax function.

Figure 1:
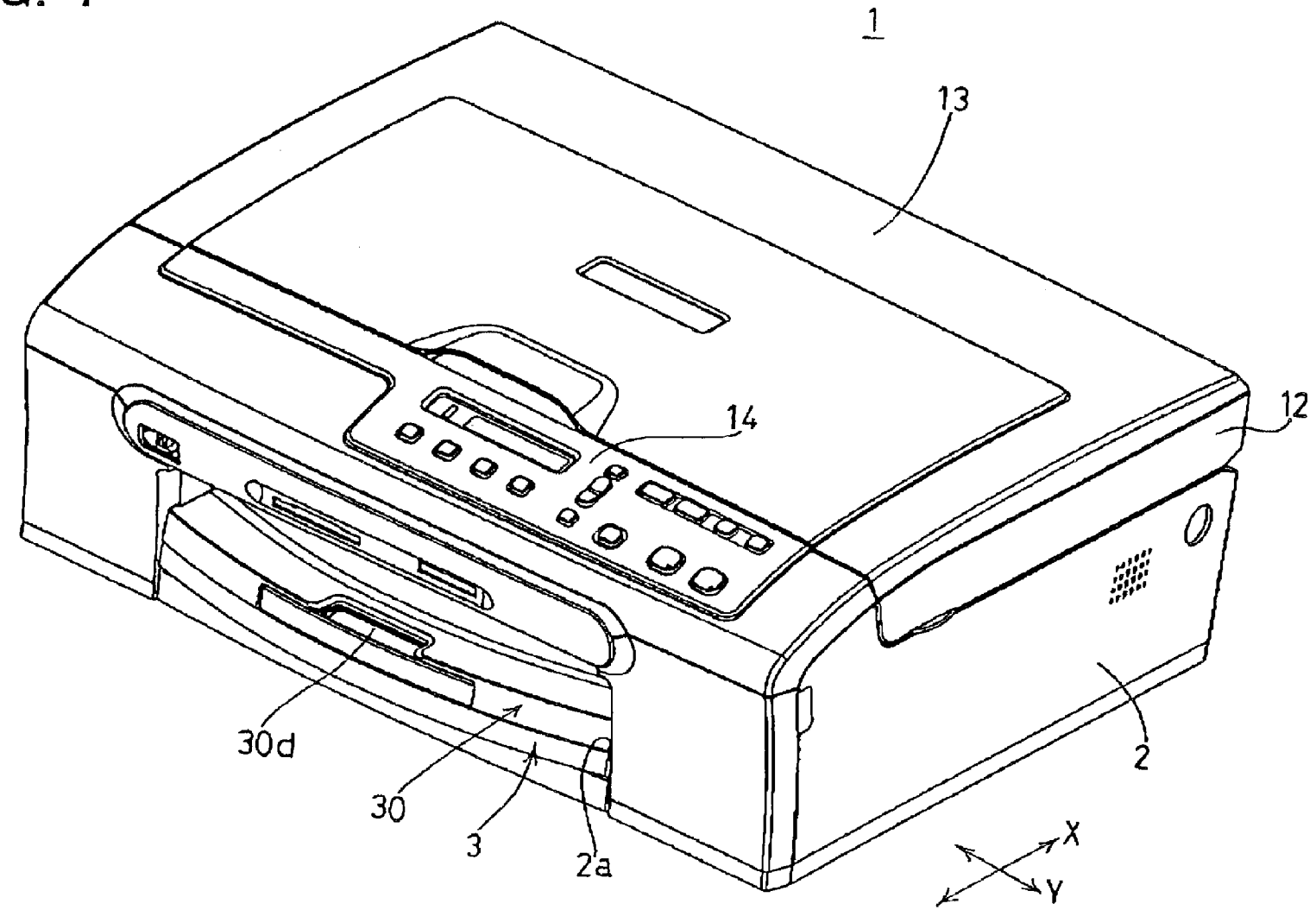
FIG. 1 shows a perspective view of an image forming device of the present embodiment.
Figure 2:
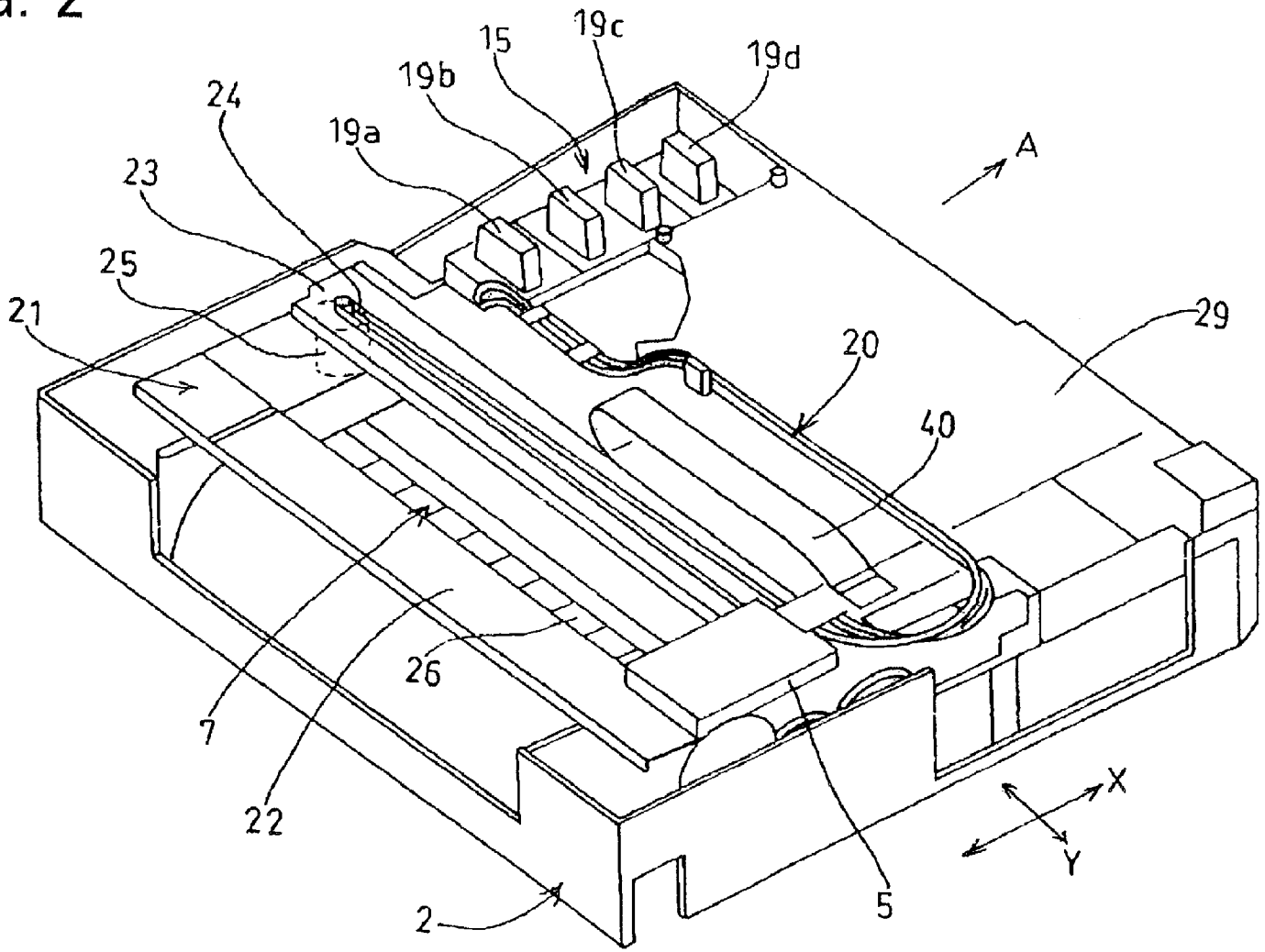
FIG. 2 shows an inner configuration of the image forming device.
Figure 3:
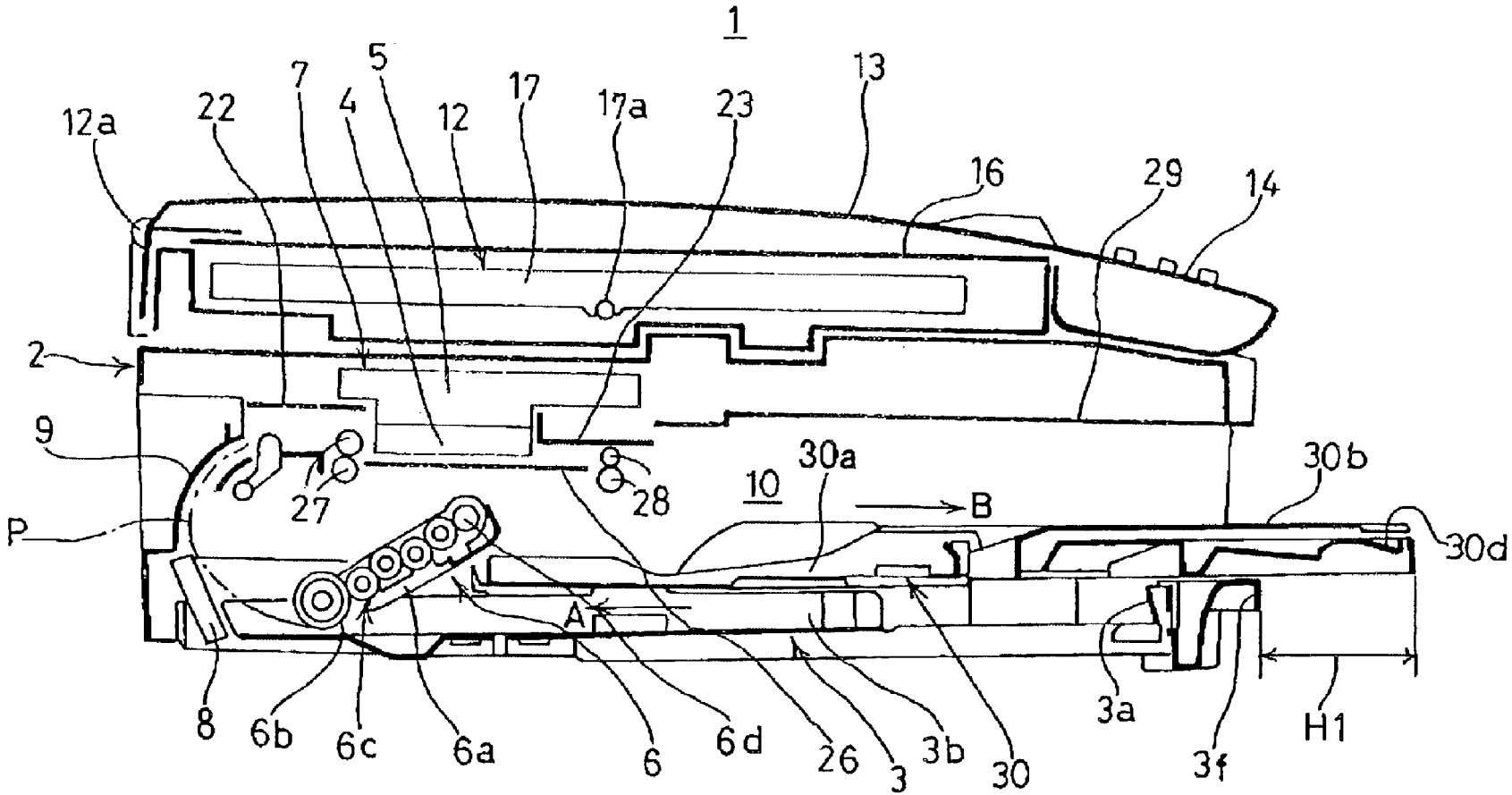
FIG. 3 shows a cross-sectional view of the image forming device.

FIG. 1 shows a perspective view of the image forming device 1. FIG. 2 shows an inner configuration of the image forming device 1. FIG. 3 shows a simplified cross-sectional view of the image forming device 1.

The image forming device 1 comprises a housing 2, a first feeding cassette 3, etc. The housing 2 is injection molded from synthetic resin. The first feeding cassette 3 is disposed at a base part of the housing 2. The first feeding cassette 3 is pushed into the housing 2 from an opening 2*a* of the housing 2. A second feeding cassette 30 (to be described) joins with or is mounted on an upper surface of the first feeding cassette 3. The second feeding cassette 30 is capable of sliding in the X direction of FIG. 1 (the left-right direction of FIG. 3) with respect to the first feeding cassette 3. Below, the side that has the opening 2*a* will be termed the front side of the image forming device 1, and the side far from the opening 2*a* will be termed the rear side of the image forming device 1.

A scanner 12 is disposed at an upper part of the housing 2. The scanner 12 reads a document when the copy function or fax function is to be executed. A cover body 13 that covers an upper surface of the scanner 12 is disposed above the scanner 12. The cover body 13 is capable of rotating with an axis 12*a* (see FIG. 3) as its center. The axis 12*a* is disposed at a rear end of the scanner 12.

As shown in FIG. 3, a glass plate 16 is formed at the upper surface of the scanner 12. The glass plate 16 is exposed when the cover body 13 is open with respect to the scanner 12. Documents to be scanned are mounted on the glass plate 16. A contact image sensor 17 (CIS) is disposed below the glass plate 16. The CIS 17 is capable of moving along a guide shaft 17*a*. The guide shaft 17*a* extends in a direction perpendicular to the plane of the paper in FIG. 3 (the main scanning direction, the Y direction in FIGS. 1 and 2).

An operation panel 14 is disposed to the front of the scanner 12 above the housing 2. The operation panel 14 has operation buttons, a liquid crystal display, etc.

A printing part 7, a paper discharge part 10, and an ink storage part 15, etc. are disposed below the scanner 12 and the operation panel 14. The printing part 7 and the paper discharge part 10 are shown in FIG. 3. The ink storage part 15 is shown in FIG. 2.

As shown in FIG. 2, the printing part 7 is formed between a first guiding member 22 and a second guiding member 23. The first guiding member 22 and the second guiding member 23 are supported by a main frame 21 that has an opening formed at an upper surface thereof, and a pair of side plates that are at the left and right sides thereof. The first guiding member 22 and the second guiding member 23 extend in the Y direction (the main scanning direction).

The printing part 7 comprises a print head 4 and a carriage 5. The print head 4 is mounted in the carriage 5. The carriage 5 is supported by the first guiding member 22 and the second guiding member 23. The carriage 5 can slide in the Y direction (the main scanning direction) with respect to the first guiding member 22 and the second guiding member 23.

The arrow A in FIG. 2 refers to the transportation direction of the paper.

A timing belt 24 is disposed above the second guiding member 23. The timing belt 24 extends in the main scanning direction (the Y direction). The timing belt 24 is suspended across a pair of pulleys (not numbered). A first of the pulleys is coupled with a CR motor (carriage motor) 25. The CR motor 25 is a DC motor in the present embodiment, but may equally well be a different motor, such as a stepping motor, etc.

The second guiding member 23 comprises an encoder strip (not shown) for detecting the position of the carriage 5 in the Y direction (the main scanning direction). The encoder strip is disposed along the main scanning direction.

A platen 26 is disposed below the printing part 7. The platen 26 is disposed between the guiding members 22 and 23. The platen 26 is fixed above a base plate (not shown) of the main frame 21. The platen 26 has a flat shape extending in the Y direction. The platen 26 faces a lower surface of the print head 4.

A separating plate 29 is disposed to the front (at the right in FIG. 3) of the printing part 7. The separating plate 29 is formed from synthetic resin. The separating plate 29 extends from the second guiding member 23 to the opening 2*a* (the opening 2*a* also functions as a paper discharge opening) of the housing 2. The separating plate 29 is disposed so as to cover the top of the paper discharge part 10. The separating plate 29 is formed integrally with the housing 2.

As shown in FIG. 2, the ink storage part 15 is capable of housing four ink cartridges 19. The ink cartridge 19*a* houses black ink (BK), the ink cartridge 19*b* houses cyan ink (C), the ink cartridge 19*c* houses magenta ink (M), and the ink cartridge 19*d* houses yellow ink (Y). Each of the ink cartridges 19 has a shape that has a small area in a plan view and that is tall. The four ink cartridges 19 are aligned along the X direction. The ink cartridges 19 can be attached and detached from above.

The print head 4 is coupled with four ink tubes 20. Each of the ink tubes 20 is coupled with one corresponding ink cartridge 19. The print head 4 is an ink jet type. Further, more ink colors than four may equally well be used. In this case, the number of ink cartridges will be increased.

The four ink tubes 20 are formed into a bundle at one end part of the ink storage part 15. The ink tubes 20 extend in the Y direction from one end side (the left end side in FIG. 2) of an upper surface of the separating plate 29 toward the other end side (the right end side in FIG. 2). At least a part of the ink tubes 20 is supported by the separating plate 29.

The printing part 7 comprises an ink receiving part and a maintenance unit (neither are shown). The ink receiving part is disposed at one end side in the Y direction, and the maintenance unit is disposed at the other end side in the Y direction. The ink receiving part and the maintenance unit are disposed outward with respect to the width of paper P (the shorter side of the paper P).

The print head 4 is capable of executing a flushing operation wherein ink is discharged toward the ink receiving part. It is thus possible to prevent nozzles of the print head 4 from being blocked.

The nozzles of the print head 4 are covered by a cap part of the maintenance unit while the printing operation is not being executed. The maintenance unit is capable of executing a process of sucking ink out of the nozzles of the print head 4. Furthermore, the maintenance unit is capable of executing a process of removing air bubbles from within a buffer tank (not shown).

In the case where the carriage 5 moves to a region facing the maintenance unit, nozzle surfaces of the print head 4 are cleaned by a cleaner (a wiper blade: not shown).

One end of a flexible flat cable (FFC) 40 is connected with the print head 4. The other end of the FFC 40 is connected with a control part (not shown) formed at the housing 2 side. The FFC 40 transmits control signals from the control part to the print head 4. The print head 4 selectively discharges ink from the nozzles based on the control signals. The FFC 40 is disposed substantially parallel to the direction in which the ink tubes 20 extend.

In the Y direction, the direction in which the ink tubes 20 bend and the direction in which the FFC 40 bends are opposing directions. The ink tubes 20 and the FFC 40 can thus be disposed at approximately the same height in a vertical direction (within an approximately horizontal plane). As a result, the image forming device 1 can be made thinner.

As shown in FIG. 3, a pair of resist rollers 27 is disposed at a left side of the platen 26. The pair of resist rollers 27 transports the paper P to a bottom surface of the print head 4. Further, a pair of paper discharge rollers 28 is disposed at a right side of the platen 26. The pair of paper discharge rollers 28 transports the paper P that has been printed by the print head 4 to the paper discharge part 10. Moreover, a following roller out of the pair of paper discharge rollers 28 is a spur roller.

As shown in FIG. 3, the image forming device 1 comprises the first feeding cassette 3, the second feeding cassette 30, and a feeding device 6. The first feeding cassette 3 has a housing part 3*b* capable of housing a plurality of sheets of paper P. The paper P in the housing part 3*b* is transported one sheet at a time to the printing part 7 by the feeding device 6.

The first feeding cassette 3 is pushed into the housing 2 from the opening 2*a* (see FIG. 1) of the housing 2. The first feeding cassette 3 is housed within the housing 2. FIG. 3 shows the first feeding cassette 3 in a state where it is located at a position furthermost to the rear in the housing 2 (furthermost to the interior of the housing 2). This state is called a first feeding position.

The first feeding cassette 3 is capable of housing a plurality of sheets of paper P that have been cut to a size such as A4 size, letter size, legal size, etc. When the paper is in a housed state in the first feeding cassette 3, the short sides of the paper P extend in the Y direction (the direction perpendicular to the plane of the page of FIG. 3, the main scanning direction). In the present embodiment, the housing part 3*b* of the first feeding cassette 3 can house a maximum of 100 sheets of paper P. The height of the paper P at this juncture is approximately 10 mm.

A regulating member 3*a* that makes contact with the paper P is disposed at a front end part (a right end part in FIG. 3) of the first feeding cassette 3. The regulating member 3*a* is capable of moving in the X direction with respect to the first feeding cassette 3 (the left-right direction in FIG. 3, the paper transportation direction, the sub-scanning direction). The regulating member 3*a* prevents the paper housed in the first feeding cassette 3 from moving forward (toward the right in FIG. 3).

Furthermore, a handle 3*f* is formed at the front end part (the right end part in FIG. 3) of the first feeding cassette 3. The user can press the handle 3*f* with a finger when the first feeding cassette 3 is to be removed from the housing 2 (or when it is to be attached to the housing 2).

Figure 6:
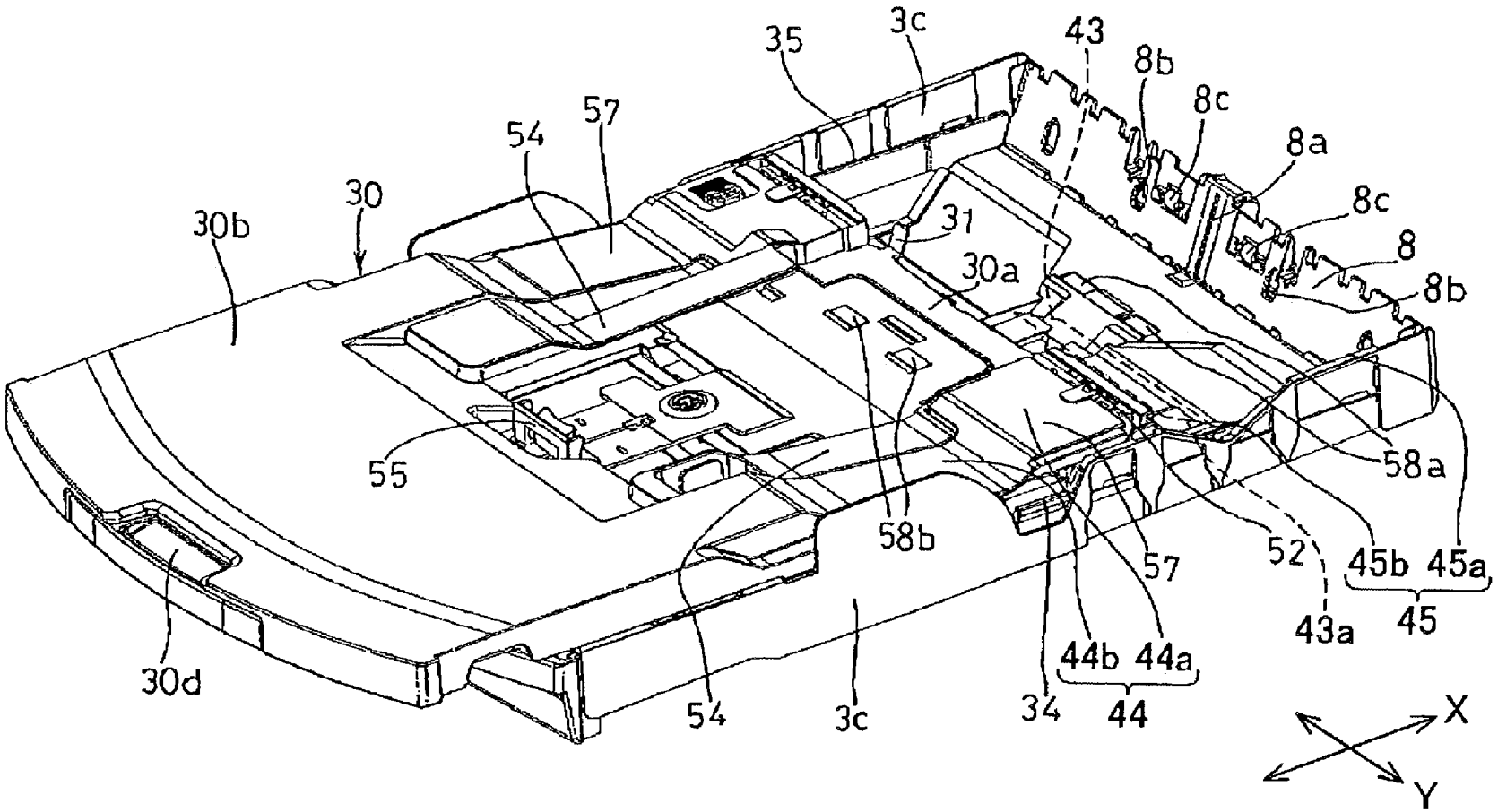
FIG. 6 shows a perspective view of a first feeding cassette and the second feeding cassette.

A pair of guide bodies 34 is provided within the housing part 3*b* of the first feeding cassette 3. The guide bodies 34 are shown in FIG. 6 (only one of the guide bodies 34 is shown in FIG. 6). The pair of guide bodies 34 is disposed such that the width (the short sides) of the paper P is disposed therebetween. A rack body (not shown) is connected with a base part of the pair of guide bodies 34. The rack body meshes with a gear (not shown) disposed at a central position in the widthwise direction of the first feeding cassette 3. The guide bodies 34 are capable of sliding in the Y direction. The guide bodies 34 can slide such that a central line in the widthwise direction of the first feeding cassette 3 is identical with a central line in the widthwise direction of the paper P. That is, when the first of the guide bodies 34 slides toward the other of the guide bodies 34, the other of the guide bodies 34 also slides toward the first of the guide bodies 34. Further, when the first of the guide bodies 34 slides away from the other of the guide bodies 34, the other of the guide bodies 34 also slides away from the first of the guide bodies 34. The pair of guide bodies 34 determines the position of the paper P in the widthwise direction.

The first feeding cassette 3 comprises a pair of base pads 58*a*. The pair of base pads 58*a* is disposed in a position corresponding to a feeding roller 6*b* (to be described). The base pads 58*a* consist of a member (such as cork) that has greater frictional resistance than the other parts of the first feeding cassette 3. The rotating force of the feeding roller 6*b* is thus transferred reliably to the paper P even if only one sheet of paper P is left in the first feeding cassette 3.

An oblique separating plate 8 is disposed at a rear end part (a left end part in FIG. 3) of the first feeding cassette 3. The shape of the oblique separating plate 8 can be understood clearly from FIG. 6. A separating pad 8*a* is coupled with the oblique separating plate 8. The separating pad 8*a* of the present embodiment is a saw-tooth shaped metal plate spring. The separating pad 8*a* is disposed at a central inner face side in the widthwise direction (the Y direction) of the oblique separating plate 8. In the case where two or more overlapping sheets of paper P have been transported from the first feeding cassette 3 (or the second feeding cassette 30), the separating pad 8*a* separates the paper P such that only one of these sheets will be transported.

A surface of the oblique separating plate 8 is convex at a central portion and is concave at the two edge sides in the widthwise direction of the paper P (the Y direction). Since the surface of the oblique separating plate 8 is thus uneven, a central part of the paper P in the widthwise direction makes contact with the separating pad Sa before the side parts of the paper P in the widthwise direction make contact with the oblique separating plate 8. The plurality of sheets of paper P can thus be separated reliably.

A pair of rollers 8*c* are disposed at both sides of the separating pad 8*a*. The pair of rollers 8*c* rotate so as to transport the paper P smoothly.

Moreover, the oblique separating plate 8 is formed separately from the first feeding cassette 3 The oblique separating plate 8 is attached detachably to the first feeding cassette 3.

As shown in FIG. 3, the second feeding cassette 30 is disposed above the first feeding cassette 3. The second feeding cassette 30 can slide in the left-right direction of FIG. 3 with respect to the first feeding cassette 3. The second feeding cassette 30 has a housing part 30*a* capable of housing a plurality of sheets of paper P1. The housing part 30*a* can house the printing paper P1 that has a smaller size than the printing paper P housed by the first feeding cassette 3.

The second feeding cassette 30 comprises a mounting part (the housing part) 30*a* of the paper P1 and a discharged paper receiving part 30*b*. The discharged paper receiving part 30*b* is formed at the right side (the right side of FIG. 3, the upstream side in the paper transportation direction) of the mounting part 30*a*. A handle 30*d* is formed at a front end part (a right end part in FIG. 3, a part at the upstream side in the paper transportation direction) of the discharged paper receiving part 30*b*. The user can press the handle 30*d* with a finger when the second feeding cassette 30 is to be slid with respect to the first feeding cassette 3.

The mounting part 30*a* is capable of housing paper P1 that is smaller in size than the paper P housed in the first feeding cassette 3 (e.g. postcards, L print paper for photographs, etc.).

Figure 7:
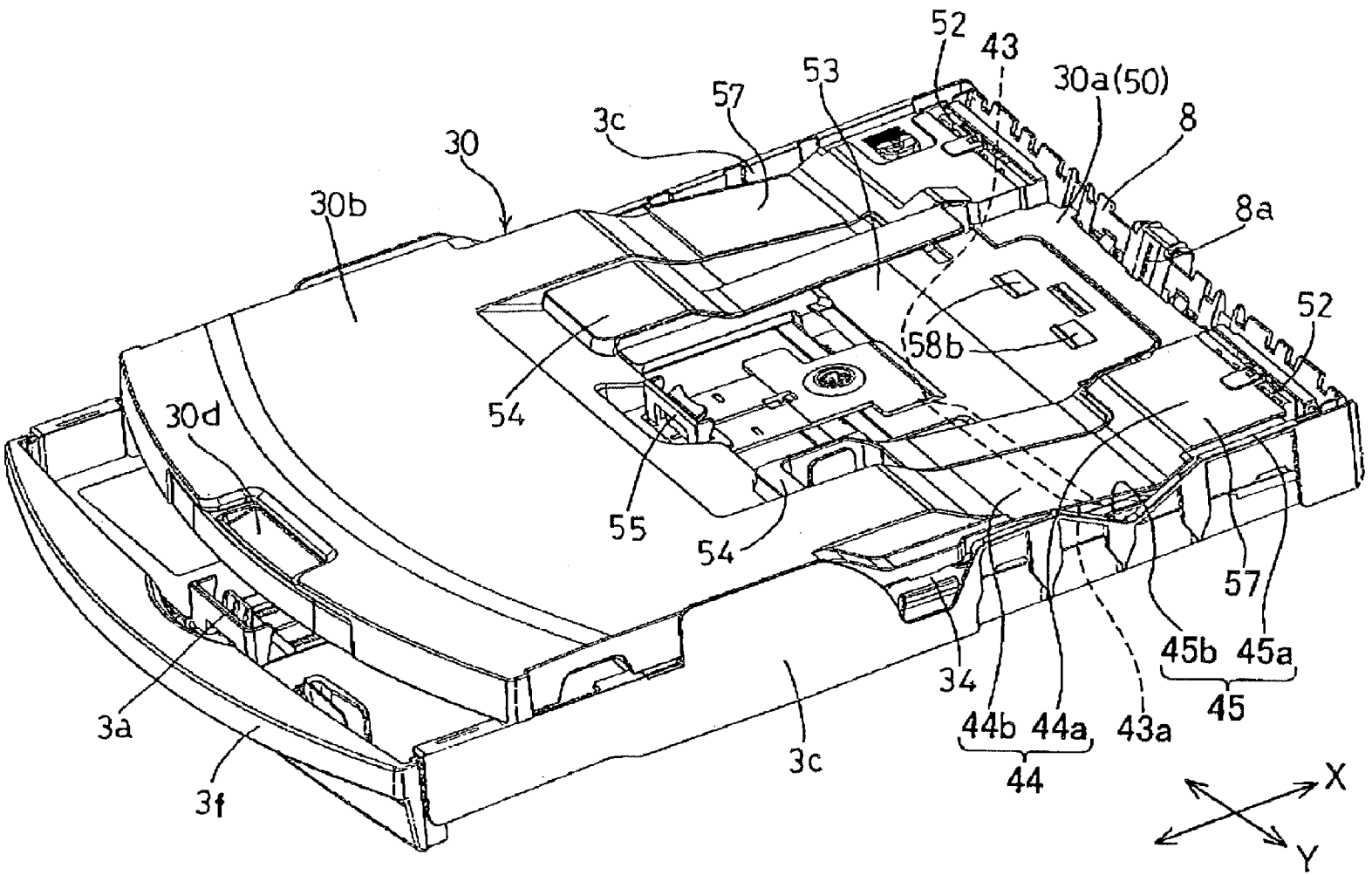
FIG. 7 shows a perspective view of the first feeding cassette and the second feeding cassette.

The paper P1 may equally well be paper that has the same size as the paper P housed in the first feeding cassette 3, but of a different type (e.g. specialized ink jet printer paper, glossy paper for photographs, etc.). The position of the paper P1 is determined by a guide 53 provided on the mounting part 30*a*. The guide 53 is shown in FIG. 7, etc. The guide 53 will be described later.

Figure 8:
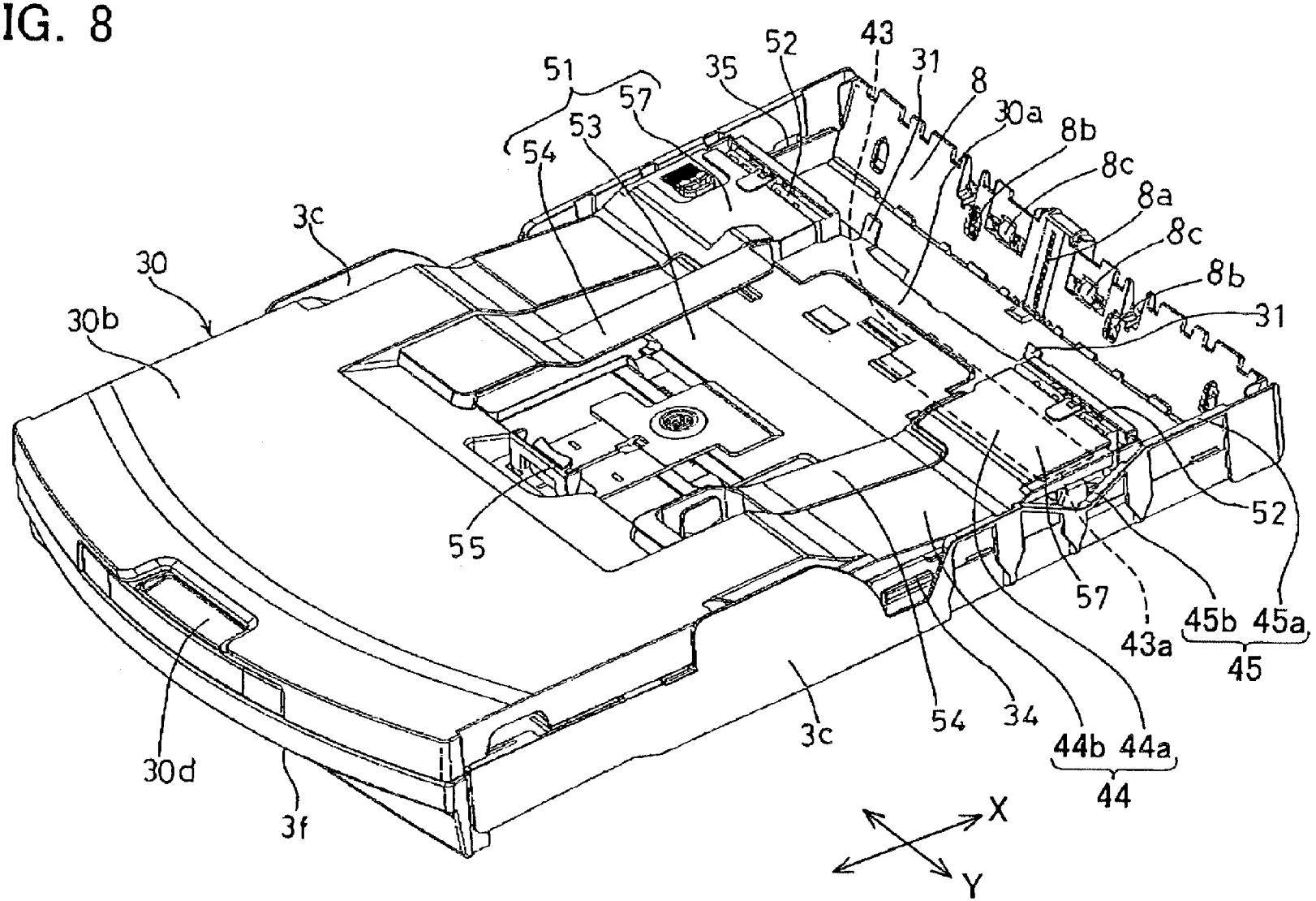
FIG. 8 shows a perspective view of the first feeding cassette and the second feeding cassette.

The mounting part 30*a* comprises a fixed part 50 and a moving part 51. The fixed part 50 is shown in FIG. 7. The moving part 51 is shown in FIG. 8. The fixed part 50 is a part that receives pushing force from the feeding roller 6*b* when the feeding roller 6*b* (to be described) makes contact with the paper P1 of the second feeding cassette 30. The fixed part 50 does not change position when the paper in the first feeding cassette 3 is to be refilled. The moving part 51 is capable of swinging upward when the paper in the first feeding cassette 3 is to be refilled.

As shown in FIG. 7, the fixed part SO is disposed at a rear end part (a part at the downstream side in the paper transportation direction) of the mounting part 30*a*. The fixed part 50 is formed at a central part in the Y direction (widthwise direction) of the second feeding cassette 30. A pair of hinges 52 is disposed at left and right edges of the fixed part 50. The pair of hinges 52 protrude respectively toward left and right side plates 3*c* of the first feeding cassette 3. The moving part 51 is connected with the fixed part 50 in a manner allowing swinging by the hinges 52.

The fixed part 50 comprises a pair of base pads 58*b*. The pair of base pads 58*b* is disposed in a position corresponding to the feeding roller 6*b* (to be described). The base pads 58*b* consist of a member (such as cork) that has greater frictional resistance than the other parts of the fixed part 50. The rotating force of the feeding roller 6*b* is thus transferred reliably to the paper P1 even if only one sheet of paper P1 is left in the second feeding cassette 30.

The moving part 51 comprises a pair of wing parts 57 and the guide 53. The guide 53 joins the pair of wing parts 57. The discharged paper receiving part 30*b* is joined with the pair of wing parts 57. The guide 53 comprises a pair of side guides 54. The pair of side guides 54 determine the position of the paper P1 in the widthwise direction.

Further, the guide 53 comprises a rear guide 55. The rear guide 55 determines the position at the rear end (the furthermost upstream end in the paper transportation direction) of the paper P1.

The hinges 52 and the wing parts 57 are capable of sliding along a rail 35 (see FIG. 6) formed at each of the pair of side plates 3*c* of the first feeding cassette 3. The hinges 52 and the wing parts 57 have stoppers (not shown) to prevent them separating from the rail 35. As a result, the second feeding cassette 30 does not readily separate from the first feeding cassette 3.

The discharged paper receiving part 30*b* of the second feeding cassette 30 has approximately the same widthwise dimensions as those of the first feeding cassette 3. As a result, the discharged paper receiving part 30*b* is capable of reliably receiving the large size paper P housed in the first feeding cassette 3 when this paper P is printed.

The moving part 51 (see FIG. 8) is capable of rotating between a position covering the housing part 3*b* of the first feeding cassette 3, and a position in which at least a part of the housing part 3*b* is open. The moving part 51 rotates with the hinges 52 as the center. When the moving part 51 rotates upward, a front side (the upstream side in the direction of transportation) of the housing part 3*b* becomes open. In the case where the moving part 51 is in the position covering the housing part 3*b*, the paper P1 is mounted so as to spread across both the fixed pat 50 and the moving part 51. In the case where the moving part 51 is in the position where the housing part 3*b* is open, the paper P1 is lifted together with the moving part 51. In this case, the paper P1 moves away from the fixed part 50.

In the widthwise direction of the paper P1, the mounting part 30*a* of the second feeding cassette 30 is positioned within a range that includes the separating pad 8*a*. The separating pad 8*a* is capable of separating the paper P1 that is being transported from the second feeding cassette 30. That is, the separating pad 8*a* separates both the paper P that is transported from the first feeding cassette 3, as well as the paper P1 that is transported from the second feeding cassette 30.

Further, the feeding device 6 (to be described) transports both the paper P of the first feeding cassette 3, as well as the paper P1 of the second feeding cassette 30.

Figure 4:
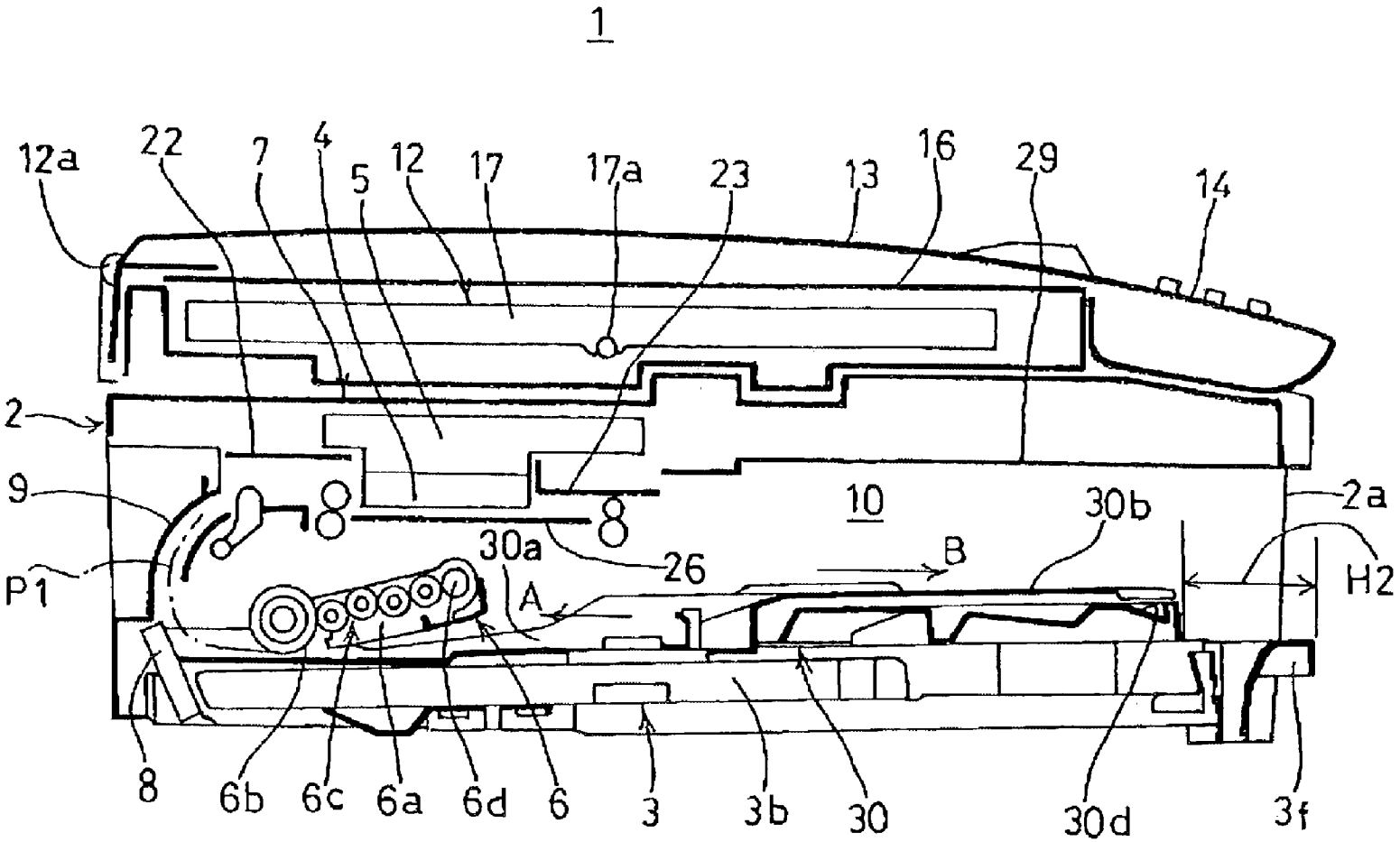
FIG. 4 shows a cross-sectional view of the image forming device.
Figure 5:
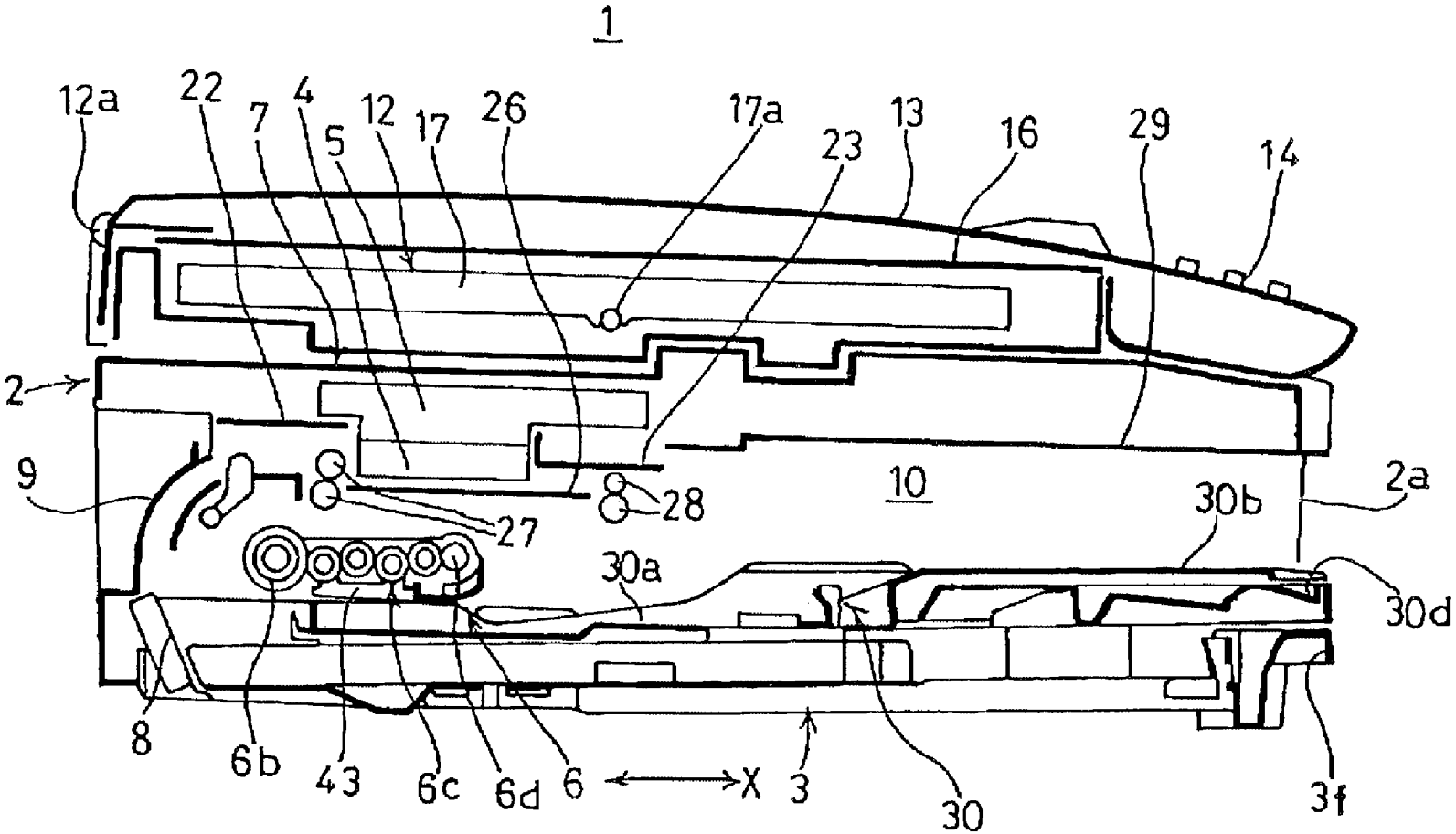
FIG. 5 shows a cross-sectional view of the image forming device.

As described above, the second feeding cassette 30 is capable of sliding in a front-rear direction (the paper transportation direction) with respect to the first feeding cassette 3. In FIG. 4 and FIG. 7, the second feeding cassette 30 is shown in a state furthermost to the rear. This is termed a second feeding position. In FIG. 3 and FIG. 6, the second feeding cassette 30 is shown in a state furthermost to the front. This is termed a second non-feeding position. In FIG. 5 and FIG. 8, the second feeding cassette 30 is shown located at a central position between the feeding position and the non-feeding position.

In the case where the second feeding cassette 30 has been set furthermost to the front (furthermost upstream in the paper transportation direction) with respect to the first feeding cassette 3 (i.e. in the case where the second feeding cassette 30 is in the second non-feeding position), at least a pan of the discharged paper receiving part 30*b* of the second feeding cassette 30 protrudes outward (to the front) past the opening 2*a* of the housing 2 (see FIG. 3). That is, when the image forming device 1 is viewed from a plan view, the user can visually discern the second feeding cassette 30. In this state, the front end (the handle 30*d*) of the second feeding cassette 30 is positioned further to the front (at the right in FIG. 3) than the front end (the handle 3*f*) of the first feeding cassette 3. A distance between the front end (the handle 30*d*) of the second feeding cassette 30 and the front end (the handle 3*f*) of the fist feeding cassette 3 is a distance H1. In this case, the handle 30*d* of the second feeding cassette 30 is in a position that does not interfere with the first feeding cassette 3. That is, when the image forming device 1 is viewed from a plan view, the handle 30*d* of the second feeding cassette 30 does not overlap with the first feeding cassette 3.

In the case where the second feeding cassette 30 has been set furthermost to the rear (furthermost downstream in the paper transportation direction) with respect to the first feeding cassette 3 (i.e. in the second feeding position), the entire second feeding cassette 30 is positioned within the housing 2 (see FIG. 4). That is, when the image forming device 1 is viewed from a plan view, the user cannot visually discern the second feeding cassette 30, and the user cannot visually discern the first feeding cassette 3 either. In this state, the front end (the handle 30*d*) of the second feeding cassette 30 is positioned further to the rear (at the left in FIG. 4) than the front end (the handle 3*f*) of the first feeding cassette 3. A distance between the front end (the handle 30*d*) of the second feeding cassette 30 and the front end (the handle 3*f*) of the first feeding cassette 3 is a distance H2.

In the case where the second feeding cassette 30 has been set in the central position, the front end of the second feeding cassette 30 is positioned at the substantially same position with the front end of the first feeding cassette 3 (see FIG. 5).

That is, the front end of the first feeding cassette 3 and the front end of the second feeding cassette 30 are disposed on substantially the same vertical plane. In this case, the front end of the first feeding cassette 3 and the front end of the second feeding cassette 30 are positioned at the substantially same position with the opening 2*a* of the housing 2.

Moreover, in the state where the first feeding cassette 3 and the second feeding cassette 30 are housed within the housing 2 and the front ends thereof (the handles 3*f* and 30*d*) are level with the opening 2*a* (see FIG. 1), the two cassettes 3 and 30 can be joined together by adhesive tape when the image forming device I is to be packaged. In this case, packaging is made simpler, and the boxes used for packaging can be reduced in size.

In the case where the second feeding cassette 30 is in the second feeding position (see FIG. 4), the second feeding cassette 30 is prevented from sliding easily with respect to the first feeding cassette 3. A mechanism for preventing this sliding will be described next.

As shown in FIGS. 6 and 8, a pair of protrusions 31 is formed at a front end part (a downstream end part in the paper transportation direction) of the second feeding cassette 30. The pair of protrusions 31 extends upward from the mounting part 30*a*.

Further, the oblique separating plate 8 is provided with a pair of position determining holes 8*b*. When the second feeding cassette 30 has been pushed into the second feeding position, the pair of protrusions 31 fits into the pair of position determining holes 8*b*. Therefore, a concave part at a lower surface of each protrusion 31 makes contact with a lower edge of each position determining hole 8*b* (this state is not shown). In the state shown in FIG. 7, the pair of protrusions 31 has been fitted into the pair of position determining holes 8*b* (however, this state cannot be seen due to the perspective view of FIG. 7). In this state, the second feeding cassette 30 is prevented from sliding easily to the left or right, or to the front or rear, with respect to the first feeding cassette 3. The state is thus maintained in which the second feeding cassette 30 is in the second feeding position.

A plurality of combinations of protrusion 31 and position determining hole 8*b* is provided at appropriate intervals along the lengthwise direction (the widthwise direction of the paper) of the oblique separating plate 8. Further, the separating pad 8*a* is located between the combinations of protrusion 31 and position determining hole 8*b*. As a result, when the second feeding cassette 30 has been set in the second feeding position with respect to the first feeding cassette 3, the second feeding cassette 30 is prevented from moving up or down, and from moving in the widthwise direction of the paper. Further, a single side of the second feeding cassette 30 is prevented from moving up or down, thus preventing the second feeding cassette 30 from inclining.

The second feeding cassette 30 can be slid quickly from the second feeding position by pulling the second feeding cassette 30 with a certain degree of force.

Next, the configuration of the feeding device 6 will be described with reference to FIG. 3 The feeding device 6 comprises a driving shaft 6*d*, a feeding arm 6*a*, a gear mechanism 6*c*, the feeding roller 6*b*, etc. The driving shaft 6*d* is supported in a manner allowing its rotation by the main frame 21 (see FIG. 2). The driving shaft 6*d* is inserted into holes formed in side plates of the main frame 21 and a pair of support plates (not shown).

A tip of the driving shaft 6*d* is inserted into a base part of the feeding arm 6*a*. The gear mechanism 6*c* is connected with the feeding arm 6*a*. The gear mechanism 6*c* is connected with the feeding roller 6*b*. The rotating force of the driving shaft 6*d* is transmitted to the feeding roller 6*b* by the gear mechanism 6*c*. In the present embodiment, the feeding roller 6*b* rotates in the clockwise direction in FIG. 3. Further, the feeding device 6 is usually pushed downward by a pushing mechanism (not shown: a torsion spring, for example).

Figure 9:
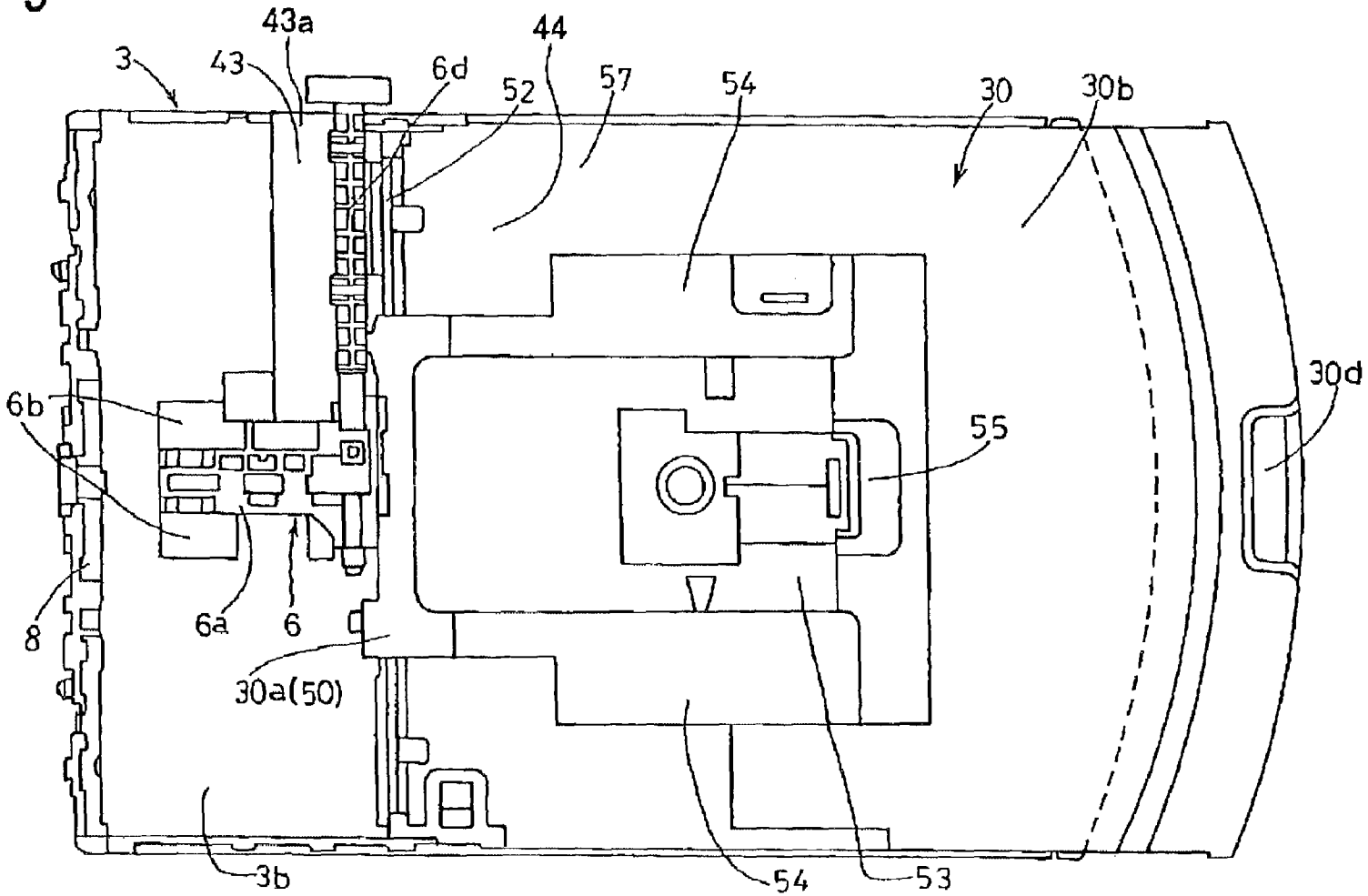
FIG. 9 shows a plan view of the first feeding cassette and the second feeding, cassette.
Figure 10:
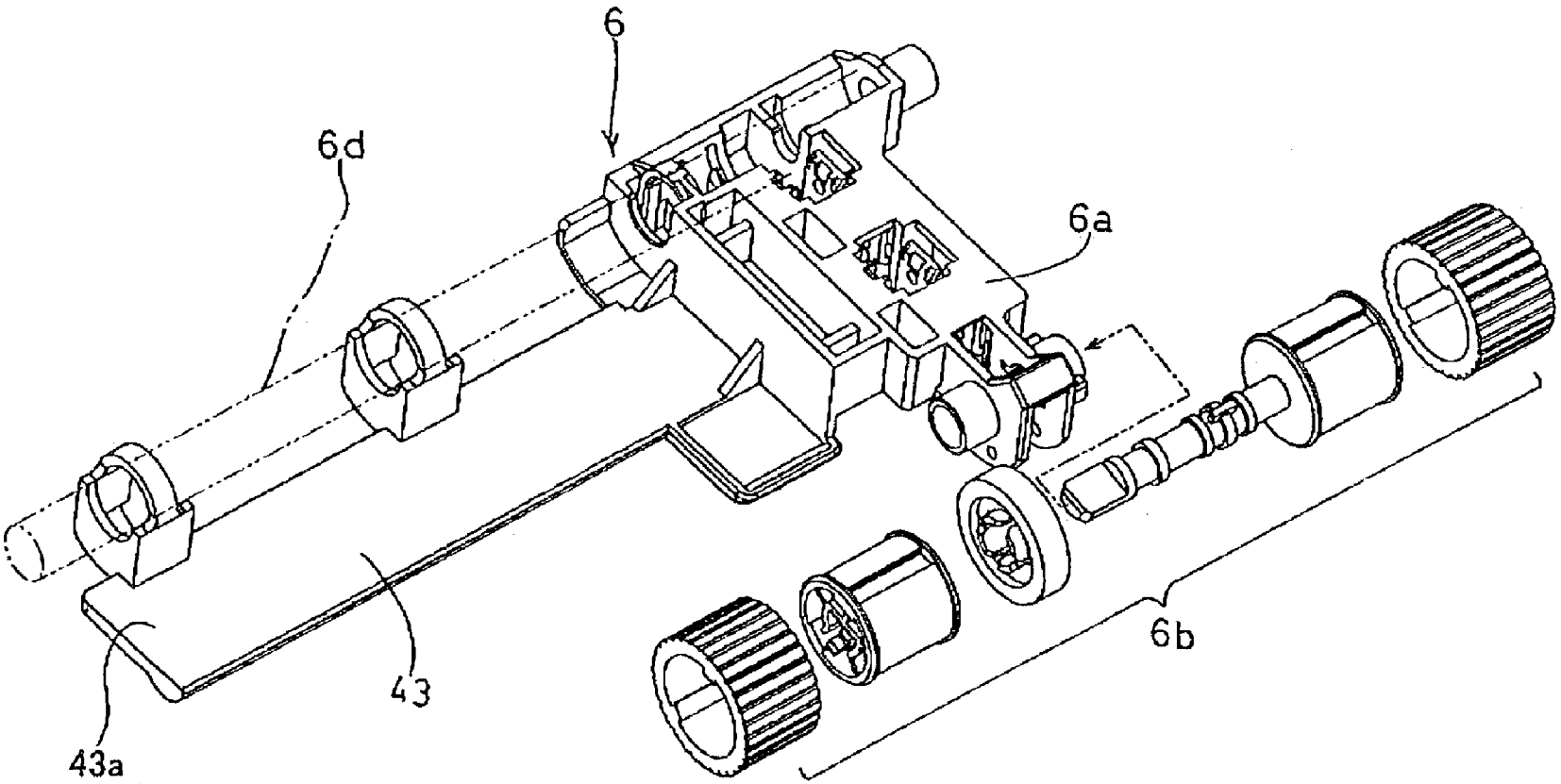
FIG. 10 shows an expanded perspective view of a feeding roller.

FIG. 9 is a plan view of the second feeding cassette 30 and the feeding device 6. FIG. 10 is a perspective view of a part of the feeding device 6. The feeding device 6 comprises a substantially plate-shaped cam follower member 43. The cam follower member 43 is formed integrally with the feeding arm 6*a*. The cam follower member 43 extends along the driving shaft 6*d* from the feeding arm 6*a*.

An auxiliary cam member 44 is formed on an upper surface of one of the wing parts 57 of the second feeding cassette 30 (the right side wing part 57 in FIG. 8, and the upper wing part 57 in FIG. 9). The auxiliary cam member 44 comprises a high part 44*a* and a low part 44*b*.

Further, as shown in FIG. 8, a main cam part 45 is formed on an upper surface of one of the side plates 3*c* of the first feeding cassette 3. The main cam part 45 comprises a high part 45*a* and a low part 45*b*.

In FIGS. 6 to 8, the cam follower member 43 is simply shown by a broken line. The cam follower member 43 is disposed in a position capable of straddling the auxiliary cam member 44 (see FIG. 7 or FIG. 8). Further, in the case where the first feeding cassette 3 is in the first feeding position, a tip part 43*a* of the cam follower member 43 is in a position corresponding to the low part 45*b* of the main cam part 45

In the case where the first feeding cassette 3 and the second feeding cassette 30 are pushed together into the housing 2, the tip part 43*a* of the cam follower member 43 passes over the high part 45*a* of the main cam part 45. This occurs irrespective of the position of the second feeding cassette 30 with respect to the first feeding cassette 3.

When the first feeding cassette 3 is pushed further into the housing 2 (when the first feeding cassette 3 is pushed to the first feeding position), the tip part 43*a* of the cam follower member 43 reaches a position corresponding to the low part 45*a* of the main cam part 45.In this state, the position of the cam follower member 43 changes according to the positional relationship between the first feeding cassette 3 and the second feeding cassette 30.

In the case where, for example, the second feeding cassette 30 is in the central position (the case shown in FIG. 8), the high part 44*a* of the auxiliary cam member 44 is in approximately the same position as the low part 45*b* of the main cam part 45. In this case, the cam follower member 43 makes contact with the high part 44*a* of the auxiliary cam member 44, and does not make contact with the main cam part 45. The cam follower member 43 is held upward by the high part 44*a* of the auxiliary cam member 44. The feeding arm 6*a* is thus swung upward. The feeding roller 6*b* does not make contact with both the paper P of the first feeding cassette 3 and the paper P1 of the second feeding cassette 30. That is, the feeding device 6 is in the state shown in FIG. 5.

In the case where the second feeding cassette 30 is in the second non-feeding position (the case shown in FIG. 6), the high part 44*a* of the auxiliary cam member 44 is disposed further to the front than the low part 45*b* of the main cam part 45 (at the left side in FIG. 6, the upstream side in the paper transportation direction). In this case, the cam follower member 43 does not make contact with the auxiliary cam member 44, and is lowered so as to make contact with the low part 45*b* of the main cam part 45. The feeding arm 6*a* is thus swung downward. In this case, the entire second feeding cassette 30 is to the front of the feeding roller 6*b*. As a result, the feeding roller 6*b* does not make contact with the paper P1 of the second feeding cassette 30, and makes contact with the paper P of the first feeding cassette 3. That is, the feeding device 6 is in the state shown in FIG. 3.

In the case where the second feeding cassette 30 is in the second feeding position (the case shown in FIG. 7), the high part 44*a* of the auxiliary cam member 44 is disposed further to the rear than the low part 45*b* of the main cam part 45 (at the right side in FIG. 7, the downstream side in the paper transportation direction). In this case, the cam follower member 43 does not make contact with the auxiliary cam member 44, and is lowered so as to make contact with the low part 45*b* of the main cam part 45. The feeding arm 6*a* is thus swung downward. In this case, the second feeding cassette 30 is in a position corresponding to the feeding roller 6*b*. As a result, the feeding roller 6*b* makes contact with the paper P1 of the second feeding cassette 30, and does not make contact with the paper P of the first feeding cassette 3. That is, the feeding device 6 is in the state shown in FIG. 4.

The user can select any of the aforementioned three positions (the second feeding position, the second non-feeding position, and the central position) by sliding the second feeding cassette 30 while the first feeding cassette 3 is set in the first feeding position.

In the case where the second feeding cassette 30 is slid from the second feeding position to the second non-feeding position (or from the second non-feeding position to the second feeding position), the second feeding cassette 30 must pass through the central position. That is, in the case where the second feeding cassette 30 is slid, the feeding roller 6*b* is moved to a position that does not interfere with the second feeding cassette 30. As a result, the feeding roller 6*b* does not topple the stack of paper P1 housed in the second feeding cassette 30 even when this second feeding cassette 30 is slid.

As described above, in the case where the second feeding cassette 30 is in the second non-feeding position (the case shown in FIG. 3), the feeding roller 6*b* makes contact with the paper P housed in the first feeding cassette 3. The feeding roller 6*b* is capable of transporting the paper P housed in the first feeding cassette 3. The paper P that has been transported by the feeding roller 6*b* is caused to make a U-turn by the oblique separating plate 8 and the guide 9, and is transported to the printing part 7 disposed above the first feeding cassette 3. The paper P that has been printed by the printing part 7 is transported to the paper discharge part 10 (in the direction of the arrow B) with the printed face thereof facing upward. The user can remove the paper P that has been disposed on the paper discharge part 10 (the discharged paper receiving part 30*b*).

When the second feeding cassette 30 is slid toward the rear (toward the left) from the state shown in FIG. 3, the state shown in FIG. 5 is reached. That is, the second feeding cassette 30 is placed in the central position. In this case, the feeding roller 6*b* makes contact with neither the paper P of the first feeding cassette 3 nor the paper P1 of the second feeding cassette 30. In this state, the paper P and the paper P1 are not transported by the feeding roller 6*b*.

When the second feeding cassette 30 is slid further toward the rear (toward the left) from the state shown in FIG. 5, the state shown in FIG. 4 is reached. That is, the second feeding cassette 30 is placed in the second feeding position. In this case, the feeding roller 6*b* makes contact with the paper P1 housed in the second feeding cassette 30. The feeding roller 6*b* is able to transport the paper P1 housed in the second feeding cassette 30. The paper P1 that has been transported by the feeding roller 6*b* is caused to make a U-turn by the oblique separating plate 8 and the guide 9, and is transported to the printing part 7. The paper P1 that has been printed by the printing part 7 is transported to the paper discharge part 10 (the discharged paper receiving part 30*b*). The user can remove the paper P1 that has been disposed on the paper discharge part 10.

With the image forming device 1 of the present embodiment, the paper on which printing is performed can be exchanged without removing the feeding cassettes 3 and 30 from the housing 2.

By changing the position of the second feeding cassette 30 with respect to the first feeding cassette 3, the user can select the following: using the paper P of the first feeding cassette 3, using the paper P1 of the second feeding cassette 30, or using neither the paper P nor P1.

In the case where the second feeding cassette 30 is in the second non-feeding position (the case shown in FIG. 3), a part of the second feeding cassette 30 protrudes to the exterior of the housing 2. The user can thus easily ascertain that the second feeding cassette 30 is in the second non-feeding position. Further, in the case where the second feeding cassette 30 is in the central position, the opening 2*a*, the front end of the first feeding cassette 3, and the front end of the second feeding cassette 30 are in the substantially same position. As a result, the user can easily ascertain that the second feeding cassette 30 is in the central position. In the case where the second feeding cassette 30 is in the second feeding position, the second feeding cassette 30 is entirely housed within the housing 2. In the case where the second feeding cassette 30 is entirely hidden, the user can easily ascertain that the second feeding cassette 30 is in the second feeding position.

With the present embodiment, the user can easily determine which paper can be used from the position of the second feeding cassette 30 with respect to the housing 2. As a result, the situation is prevented from occurring where the user disposes the second feeding cassette 30 in the wrong position.

Further, as described above, in the case where the second feeding cassette 30 has been set in the central position, the front ends of the feeding cassettes 3 and 30 can be joined together by adhesive tape when the image forming device 1 is to be packaged. Packaging is consequently simple, and the boxes used for packaging can be reduced in size.

Moreover, the feeding roller 6*b* frequently consists of a flexible member such as rubber or the like. The feeding roller 6*b* may deform when the feeding roller 6*b* is pressed against another member for a long period. Further, the member pressed by the feeding roller 6*b* (i.e. the paper P or P1) may deform. When the second feeding cassette 30 is in the central position, the feeding roller 6*b* does not make contact with either of the feeding cassettes 3 or 30. It is consequently possible to prevent the situation from occurring where the feeding roller 6*b* deforms, and to prevent the situation where the feeding roller 6*b* leaves marks on the paper P or P1. Problems in transporting the paper P and P1 are thus prevented, and it is thus possible to prevent deterioration of the printing of the paper P and P1.

In the case where the paper P is to be refilled in the first feeding cassette 3, the first feeding cassette 3 and the second feeding cassette 30 are removed from the housing 2. Irrespective of whether the second feeding cassette 30 is in the second feeding position (see FIG. 7), the second non-feeding position (see FIG. 6), or the central position (see FIG. 8), the moving part 51 of the second feeding cassette 30 is capable of being rotated upward with respect to the fixed part 50. The paper P can be refilled in the first feeding cassette 3 when the moving part 51 has rotated upward with respect to the fixed part 50. The user can thus easily perform the operation for refilling the paper P in the first feeding cassette 3.

SECOND EMBODIMENT

A second embodiment of the image forming device 1 will be described with reference to FIGS. 11 to 13. In the present embodiment, the configuration of a second feeding cassette 130 differs from the first embodiment.

Figure 11:
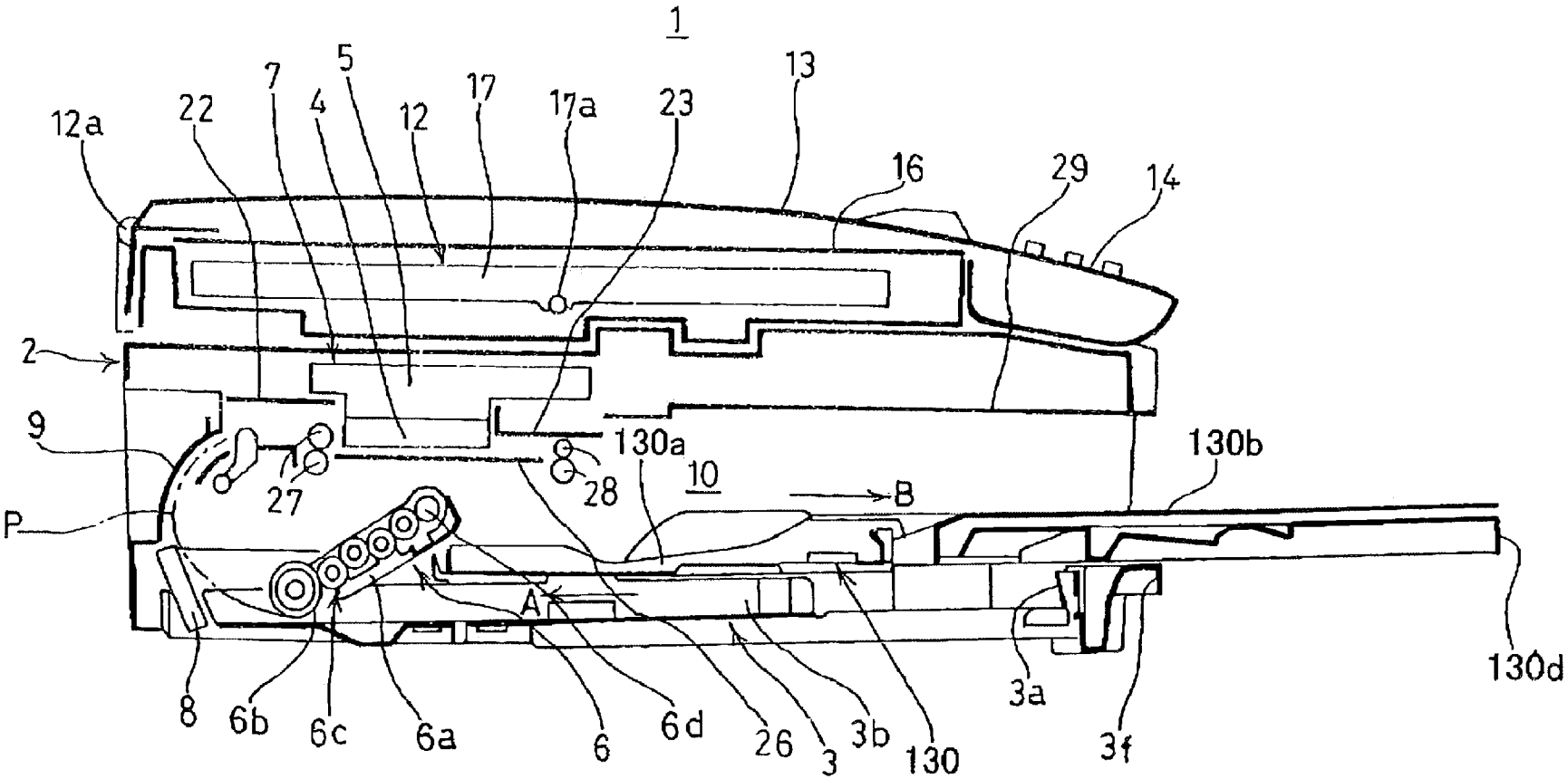
FIG. 11 shows a cross-sectional view of an image forming device (second embodiment).

FIG. 11 shows the second feeding cassette 130 located in the second non-feeding position. FIG. 12 shows the second feeding cassette 130 located in the second feeding position. FIG. 13 shows the second feeding cassette 130 located in the central position.

Figure 12:
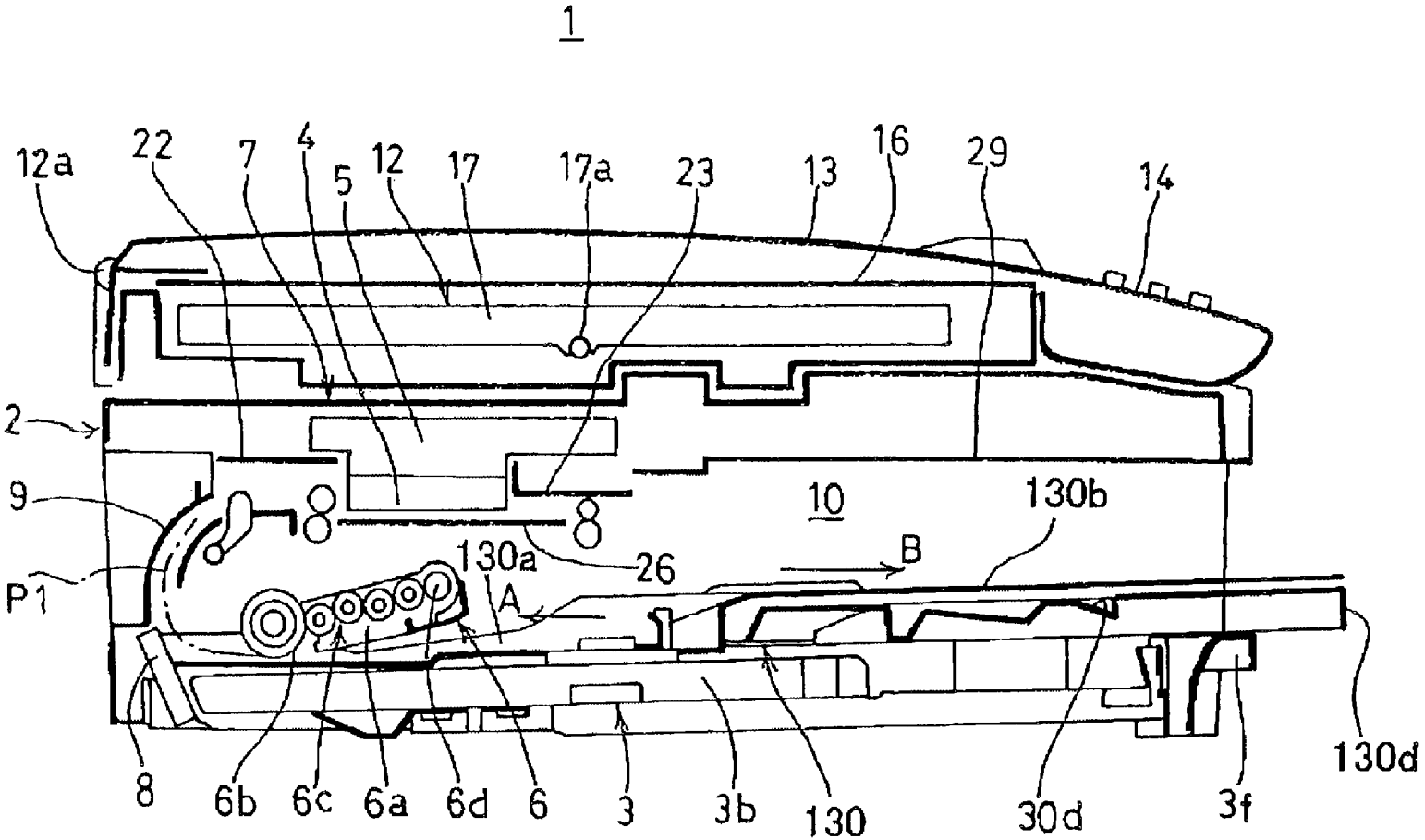
FIG. 12 shows a cross-sectional view of the image forming device (second embodiment).
Figure 13:
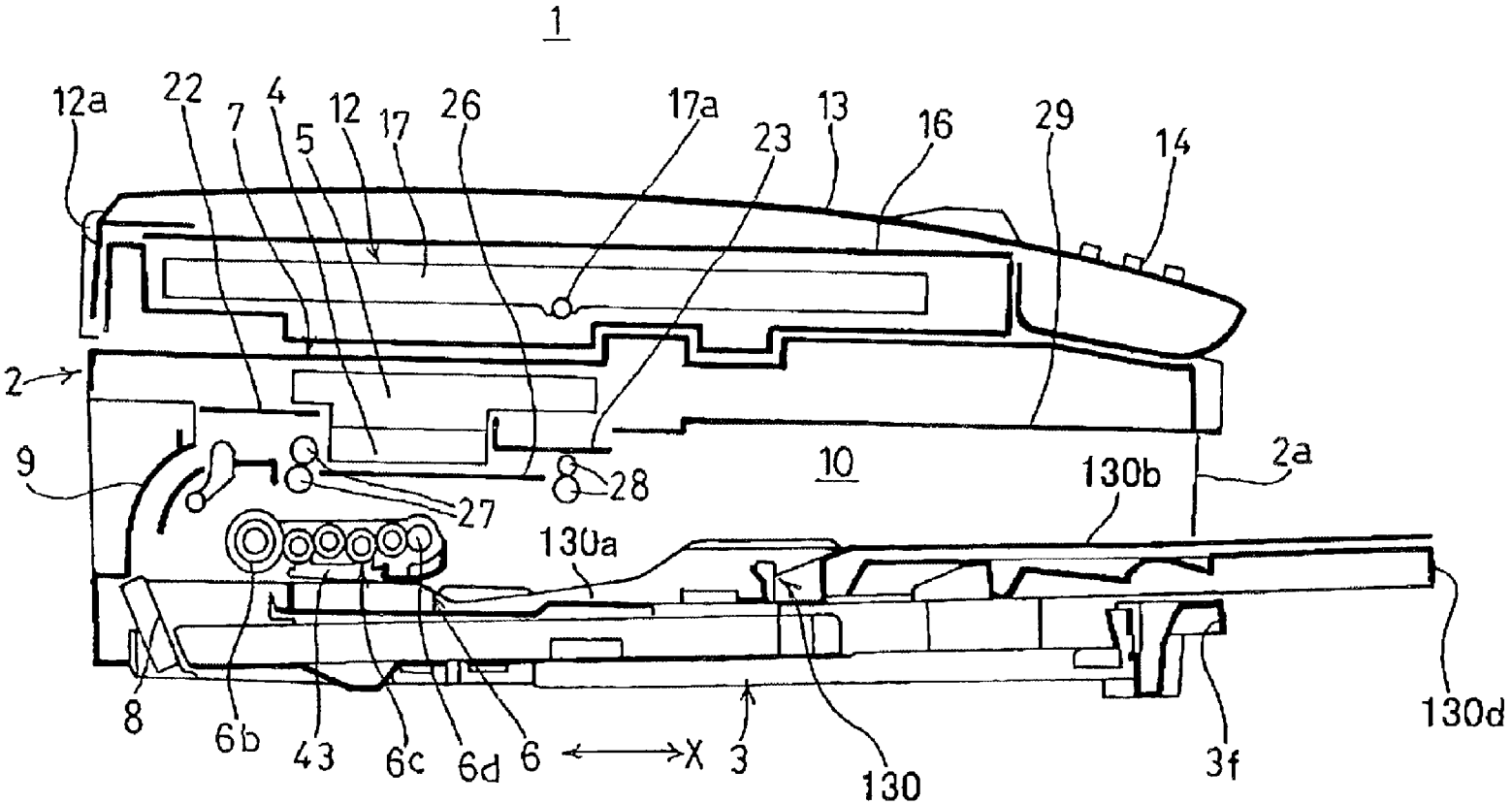
FIG. 13 shows a cross-sectional view of the image forming device (second embodiment).

In FIGS. 11, 12, and 13, the reference number 130*a* refers to a mounting part that houses the printing paper P1, the reference number 130*b* refers to a discharged paper receiving part, and the reference number 130*d* refers to a front end of the second feeding cassette 130.

The second feeding cassette 130 of the present embodiment is longer in the left-right direction of the FIG. 11, etc. than the second feeding cassette 30 of the first embodiment. As a result, the front end 130*d* of the second feeding cassette 130 is positioned to the front side of the opening 2*a* irrespective of whether the second feeding cassette 130 is in the second non-feeding position (FIG. 11), the second feeding position (FIG. 12), or the central position (FIG. 13). That is, a part of the second feeding cassette 130 is positioned at the exterior of the housing 2 irrespective of whether the second feeding cassette 130 is in the second non-feeding position, the second feeding position, or the central position. The user can invariably visually ascertain a part of the second feeding cassette 130. Consequently, the user can easily determine the position of the second feeding cassette 130.

The above embodiments are examples of the configuration of the present invention. The technical concept of the present invention can also be applied to image forming devices having a different configuration. For example, in the first embodiment, the feeding roller 6*b* makes contact with the paper P of the first feeding cassette 3 when the second feeding cassette 30 is in the state shown in FIG. 3, and the feeding roller 6*b* makes contact with the paper P1 of the second feeding cassette 30 when the second feeding cassette 30 is in the state shown in FIG. 4. A configuration that is the reverse of this may equally well be adopted. That is, the feeding roller 6*b* may make contact with the paper P1 of the second feeding cassette 30 when the second feeding cassette 30 is in the state shown in FIG. 3, and the feeding roller 6*b* may make contact with the paper P of the first feeding cassette 3 when the second feeding cassette 30 is in the state shown in FIG. 4.

What is claimed is:

1. An image forming device, comprising:

a device main body;

a first cassette in which a print medium is housed, the first cassette housed in the device main body;

a second cassette in which a print medium is housed, the second cassette housed in the device main body, wherein the second cassette linearly slides through an entire range between a first position and a second position with respect to the device main body, a third position being located between the first position and the second position, the second cassette linearly slides from the first position to the second position via the third position, and the second cassette linearly slides from the second position to the first position via the third position;

a transportation device that transports the print medium housed in the first cassette when the first cassette is positioned at a predetermined position with respect to the device main body and the second cassette is positioned at the first position, wherein the transportation device transports the print medium housed in the second cassette when the second cassette is positioned at the second position, and the transportation device prohibits transporting the print medium housed in the first cassette and the print medium housed in the second cassette when the second cassette is positioned at the third position; and a printing device that prints an image on the print medium transported by the transportation device.

2. The image forming device as in claim 1, wherein the second cassette linearly slides in a substantially horizontal direction between the first position and the second position.

3. An image forming device, comprising:

a device main body;

a first cassette in which a print medium is housed, the first cassette housed in the device main body;

a second cassette in which a print medium is housed, the second cassette housed in the device main body, wherein the second cassette linearly slides through an entire range between a first position and a second position with respect to the device main body, a third position being located between the first position and the second position, the second cassette linearly slides from the first position to the second position via the third position, and the second cassette linearly slides from the second position to the first position via the third position;

a transportation device that transports the print medium housed in the first cassette when the first cassette is positioned at a predetermined position with respect to the device main body and the second cassette is positioned at the first position, wherein the transportation device transports the print medium housed in the second cassette when the second cassette is positioned at the second position, and the transportation device prohibits transporting the print medium housed in the first cassette and the print medium housed in the second cassette when the second cassette is positioned at the third position; and a printing device that prints an image on the print medium transported by the transportation device, wherein a part of the second cassette positioned at the first position is positioned outside the device main body.

4. The image forming device as in claim 3, wherein the second cassette is supported by the first cassette, and the second cassette linearly slides with respect to the first cassette.

5. The image forming device as in claim 3, wherein the first cassette is detachable from the device main body, and the transportation device transports the print medium housed in the second cassette when the first cassette is positioned at the predetermined position and the second cassette is positioned at the second position.

6. The image forming device as in claim 1, wherein any part of the second cassette positioned at the second position is not positioned outside the device main body.

7. The image forming device as in claim 1, wherein the device main body comprises an opening, the second cassette linearly slides through the opening, one end of the second cassette positioned at the first position is positioned outside the device main body, and the one end of the second cassette positioned at the second position is positioned inside the device main body, and the one end of the second cassette positioned at the third position is positioned at the substantially same position with the opening.

8. The image forming device as in claim 1, wherein
the second cassette is supported by the first cassette,
the first cassette and the second cassette are attached to the device main body together, and
the first cassette and the second cassette are detached from the device main body together.

9. The image forming device as in claim 1, wherein
the transportation device comprises a feeding roller, and
the feeding roller makes contact with the print medium housed in the first cassette when the first cassette is positioned at the predetermined position and the second cassette is positioned at the first position, and makes contact with the print medium housed in the second cassette when the second cassette is positioned at the second position.

10. The image forming device as in claim 9, wherein
the feeding roller does not make contact with the print medium housed in the first cassette and the print medium housed in the second cassette when the second cassette is positioned at the third position between the first position and the second position.

11. The image forming device as in claim 1, wherein
the first position is the furthermost upstream position in a transportation direction of the print medium, and
the second position is the furthermost downstream position in the transportation direction of the print medium.

12. The image forming device as in claim 1, wherein
the second cassette is disposed above the first cassette, and
the printing device is disposed above the second cassette.

13. The image forming device as in claim 1, wherein
the second cassette comprises a first portion in which the print medium not having been printed is housed, and a second portion by which the print medium having been printed is supported.

14. The image forming device as in claim 1, wherein
a size of the print medium housed in the first cassette is different from a size of the print medium housed in the second cassette.

15. The image forming device as in claim 14, wherein
the size of the print medium housed in the first cassette is greater than the size of the print medium housed in the second cassette.

16. The image forming device as in claim 1, wherein
the second cassette linearly slides in a substantially horizontal direction between the first position and the second position.

* * * * *